US010199702B2

(12) United States Patent
Liao et al.

(10) Patent No.: US 10,199,702 B2
(45) Date of Patent: Feb. 5, 2019

(54) PHASE SHIFTER COMPRISING A CAVITY HAVING FIRST AND SECOND FIXED TRANSMISSION LINES WITH SLOTS THEREIN THAT ENGAGE A SLIDABLE TRANSMISSION LINE

(71) Applicant: Huawei Technologies Co., Ltd., Shenzhen (CN)

(72) Inventors: Zhiqiang Liao, Shenzhen (CN); Lei Chen, Munich (DE); Huifan Lin, Dongguan (CN); Xinneng Luo, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/454,693

(22) Filed: Mar. 9, 2017

(65) Prior Publication Data

US 2017/0179594 A1 Jun. 22, 2017

Related U.S. Application Data

(63) Continuation of application No. PCT/CN2015/089030, filed on Sep. 7, 2015.

(30) Foreign Application Priority Data

Sep. 9, 2014 (CN) ..... 2014 1 0455198

(51) Int. Cl.
*H01P 1/18* (2006.01)
*H01Q 3/32* (2006.01)
(Continued)

(52) U.S. Cl.
CPC ..... *H01P 1/184* (2013.01); *H01Q 1/246* (2013.01); *H01Q 3/32* (2013.01); *H01Q 9/0485* (2013.01)

(58) Field of Classification Search
CPC ..... H01P 1/184; H01P 1/18; H01P 9/00
(Continued)

(56) References Cited

U.S. PATENT DOCUMENTS 6,535,088 B1 3/2003 Sherman et al.
6,621,465 B2 9/2003 Teillet et al.
(Continued)

FOREIGN PATENT DOCUMENTS

CN 2845197 Y 12/2006
CN 2859838 Y 1/2007
CN 1913744 A 2/2007
CN 201417809 Y 3/2010
CN 101707271 A 5/2010
(Continued)

*Primary Examiner* — Benny Lee
(74) *Attorney, Agent, or Firm* — Leydig, Voit & Mayer, Ltd.

(57) ABSTRACT

A phase shifter includes a cavity (100) and a first fixed transmission line (301), a second fixed transmission line (302), and a slidable transmission line (201) that are located in the cavity (100). The first fixed transmission line (301) is provided with a first open slot (3011), the second fixed transmission line (302) is provided with a second open slot (3021), and opening directions of the first open slot (3011) and the second open slot (3021) are opposite to each other. Two ends of the slidable transmission line (201) are respectively clamped in the first open slot (3011) and the second open slot (3021), so that the slidable transmission line (201) is electrically connected to the first fixed transmission line (301) and the second fixed transmission line (302). The slidable transmission line (201) slides relative to the first fixed transmission line (301) and the second fixed transmission line (302).

9 Claims, 5 Drawing Sheets

(51) Int. Cl.
*H01Q 1/24* (2006.01)
*H01Q 9/04* (2006.01)

(58) Field of Classification Search
USPC ..... 333/161
See application file for complete search history.

(56) References Cited

U.S. PATENT DOCUMENTS

| | | | | |
|---|---|---|---|---|
| 2005/0184827 | A1 | 8/2005 | Pallone et al. | |
| 2007/0045000 | A1 | 3/2007 | Lin et al. | |
| 2009/0189826 | A1 | 7/2009 | Timofeev et al. | |
| 2015/0116180 | A1* | 4/2015 | Wu ..... | H01P 1/184<br>343/852 |

FOREIGN PATENT DOCUMENTS

| | | | |
|---|---|---|---|
| CN | 102082327 | A | 6/2011 |
| CN | 101707271 | B | 1/2012 |
| CN | 102480838 | A | 5/2012 |
| CN | 202564505 | U | 11/2012 |
| CN | 203435219 | U | 2/2014 |
| CN | 104269647 | A | 1/2015 |
| EP | 1033773 | A1 | 9/2000 |
| JP | H0223106 | U | 2/1990 |
| JP | 2000261203 | A | 9/2000 |
| JP | 2006278561 | A | 10/2006 |
| JP | 2009177808 | A | 8/2009 |
| WO | WO 0103233 | A1 | 1/2001 |
| WO | WO 2007036607 | A1 | 4/2007 |
| WO | 2007073638 | A1 | 7/2007 |
| WO | WO 2012106903 | A1 | 8/2012 |

* cited by examiner

PHASE SHIFTER COMPRISING A CAVITY HAVING FIRST AND SECOND FIXED TRANSMISSION LINES WITH SLOTS THEREIN THAT ENGAGE A SLIDABLE TRANSMISSION LINE

CROSS-REFERENCE TO RELATED APPLICATIONS

This application is a continuation of International Application No. PCT/CN2015/089030, filed on Sep. 7, 2015, which claims priority to Chinese Patent Application No. 201410455198.2, filed on Sep. 9, 2014. The disclosures of the aforementioned applications are hereby incorporated by reference in their entireties.

TECHNICAL FIELD

The present application relates to wireless communications technologies, and in particular, to a phase shifter.

BACKGROUND

A phase shifter is an apparatus capable of adjusting a phase of a wave, and is a core part of a base station antenna. The phase shifter changes a beam scanning angle of an array antenna to flexibly adjust a coverage area, that is an antenna pattern, of an antenna beam. Performance of the phase shifter directly affects a pattern, a gain, a dimension, even manufacturing costs, and the like of the base station antenna. Therefore, design and improvement of the phase shifter are important in overall design of the base station antenna.

To manufacture cost-effective phase shifters with high phase adjustment precision, in the prior art, a Chinese patent (Application No. 200520121325.1) in 2007 discloses a phase shifter with a continuously variable phase. Referring to FIG. 1, one end of a fixed transmission line 411 and one end of a fixed transmission line 413 are each provided with a lengthwise slot, directions of the slots face towards a "ground" layer, and the "ground" layer is a metal cavity 400. Two arms of a movable transmission line 412 are respectively disposed in the slot of the fixed transmission line 411 and the slot of the fixed transmission line 413. A total length of a transmission line formed by the fixed transmission line 411, the fixed transmission line 413, and the movable transmission line 412 is changed by using a mechanical transmission device (not shown in the figure), thereby continuously changing a phase between a coaxial connector 401 and a coaxial connector 402. However, to ensure coupling connection between the fixed transmission line and the movable transmission line, the mechanical transmission device further needs to apply, in a direction towards the slot, pressure on the movable transmission line. The phase shifter is complex for operation, and has a high performance requirement for the mechanical transmission device.

A second Chinese patent (Application No. 200520065549.5) discloses a phase shifter. Referring to FIG. 2, a structure of a phase shifter shown in FIG. 2 is similar to a structure of the phase shifter shown in FIG. 1. A difference lies in that structures of a fixed transmission line 3 and a movable transmission line 6 that are shown in FIG. 2 are tubular structures. During the assembly, the fixed transmission line and the movable transmission line need to be aligned with each other, or otherwise, an isolating layer between the fixed transmission line and the movable transmission line can be damaged, which causes severe interference to a communications system.

In addition, a specific distribution manner of a circuit on the movable transmission line is not mentioned in the foregoing two patents.

SUMMARY OF THE INVENTION

Embodiments of the present application provide a phase shifter in which a slidable transmission line and a fixed transmission line can be coupled to each other effectively.

A first aspect of the embodiments of the present application provides a phase shifter, including a cavity and a first fixed transmission line, a second fixed transmission line, and a slidable transmission line that are located in the cavity; where the first fixed transmission line is provided with a first open slot, the second fixed transmission line is provided with a second open slot, and opening directions of the first open slot and the second open slot are opposite to each other; and two ends of the slidable transmission line are respectively clamped in the first open slot and the second open slot, so that the slidable transmission line is electrically connected to the first fixed transmission line and the second fixed transmission line, and the slidable transmission line slides relative to the first fixed transmission line and the second fixed transmission line.

With reference to an implementation manner of the first aspect of the embodiments of the present application, in a first possible implementation manner of the first aspect of the embodiments of the present application, the slidable transmission line includes a dielectric substrate and a phase-shift circuit, and the dielectric substrate drives the phase-shift circuit to slide relative to the first fixed transmission line and the second fixed transmission line.

With reference to the first possible implementation manner of the first aspect of the embodiments of the present application, in a second possible implementation manner of the first aspect of the embodiments of the present application, the phase-shift circuit is disposed on a first surface of the dielectric substrate and a second surface of the dielectric substrate, the first surface and the second surface are surfaces that connect the dielectric substrate and the first open slot and the second open slot, and the first surface and the second surface are disposed opposite to each other.

With reference to the first possible implementation manner of the first aspect of the embodiments of the present application, in a third possible implementation manner of the first aspect of the embodiments of the present application, the phase-shift circuit is U-shaped, and two arms of the phase-shift circuit are respectively disposed at a junction of the dielectric substrate and the first open slot and a junction of the dielectric substrate and the second open slot.

With reference to the second possible implementation manner of the first aspect of the embodiments of the present application, in a fourth possible implementation manner of the first aspect of the embodiments of the present application, the dielectric substrate is provided with a through hole, the through hole is disposed in the phase-shift circuit, an inner wall of the through hole is coated with a metal layer, and the phase-shift circuit on the first surface is connected to the phase-shift circuit on the second surface by using the metal layer.

With reference to the fourth possible implementation manner of the first aspect of the embodiments of the present application, in a fifth possible implementation manner of the first aspect of the embodiments of the present application, a metal ring of a preset width is disposed at an edge of the through hole, the metal ring and the through hole are concentric and coaxial, and the metal ring and the phase-shift circuit are connected.

With reference to either of the second or the fourth possible implementation manner of the first aspect of the embodiments of the present application, in a sixth possible implementation manner of the first aspect of the embodiments of the present application, the first surface includes a first placement area, the second surface includes a second placement area, the phase-shift circuit on the first surface is disposed in the first placement area, and the phase-shift circuit on the second surface is disposed in the second placement area.

With reference to the sixth possible implementation manner of the first aspect of the embodiments of the present application, in a seventh possible implementation manner of the first aspect of the embodiments of the present application, structures of the first placement area and the second placement area are smooth structures.

With reference to the sixth possible implementation manner of the first aspect of the embodiments of the present application, in an eighth possible implementation manner of the first aspect of the embodiments of the present application, structures of the first placement area and the second placement area are slow-wave structures.

With reference to either of the first aspect or the first possible implementation manner of the first aspect of the embodiments of the present application, in a ninth possible implementation manner of the first aspect of the embodiments of the present application, a surface of the slidable transmission line is coated with an insulation layer.

With reference to an implementation manner of the first aspect of the embodiments of the present application, in a tenth possible implementation manner of the first aspect of the embodiments of the present application, the cavity includes a first end and a second end, the first end is provided with an accommodation cavity, the second end is a cover board, and the cover board covers the accommodation cavity.

With reference to the tenth possible implementation manner of the first aspect of the embodiments of the present application, in an eleventh possible implementation manner of the first aspect of the embodiments of the present application, the first fixed transmission line, the second fixed transmission line, and the slidable transmission line form a suspended microstrip structure in the accommodation cavity.

The phase shifter provided in the embodiments of the present application includes a cavity and a first fixed transmission line, a second fixed transmission line, and a slidable transmission line that are located in the cavity. The first fixed transmission line is provided with a first open slot, the second fixed transmission line is provided with a second open slot, and opening directions of the first open slot and the second open slot are opposite to each other. Two ends of the slidable transmission line are respectively clamped in the first open slot and the second open slot, so that the slidable transmission line is electrically connected to the first fixed transmission line and the second fixed transmission line, and the slidable transmission line slides relative to the first fixed transmission line and the second fixed transmission line. The fixed transmission lines and the slidable transmission line form a suspended microstrip structure in an accommodation cavity. The phase shifter has a simple structure and a small volume, and can adjust a phase precisely. A transmission device needs to pull only the slidable transmission line to adjust the phase, and does not need to apply additional pressure in another direction. The phase shifter is simple for operation, and has a low performance requirement for the mechanical transmission device.

BRIEF DESCRIPTION OF DRAWINGS

To describe the technical solutions in the embodiments of the present application more clearly, the following briefly describes the accompanying drawings required for describing the embodiments. Apparently, the accompanying drawings in the following description show some embodiments of the present application, and a person of ordinary skill in the art may still derive other drawings from these accompanying drawings without creative efforts.

DETAILED DESCRIPTION

The following clearly describes the technical solutions in the embodiments of the present application with reference to the accompanying drawings in the embodiments of the present application. Apparently, the described embodiments are some but not all of the embodiments of the present application. All other embodiments obtained by a person of ordinary skill in the art based on the embodiments of the present application without creative efforts shall fall within the protection scope of the present application.

The present application provides a phase shifter in which a slidable transmission line and a fixed transmission line can be coupled to each other effectively. The phase shifter has a simple structure, and has a low requirement for a transmission device.

Figure 1:
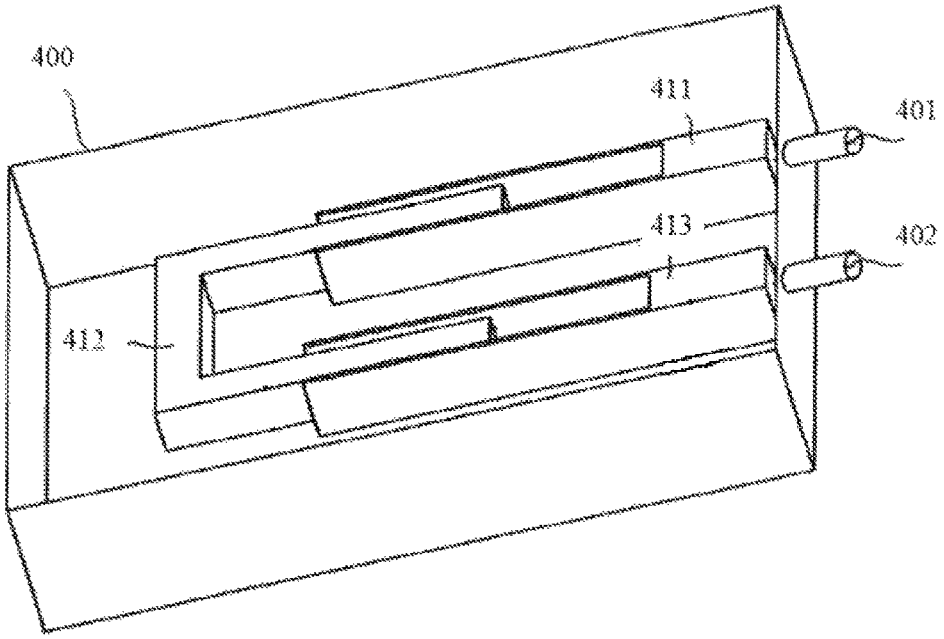
FIG. 1 PRIOR ART
FIG. 1 is a schematic diagram of a phase shifter with a continuously variable phase in the prior art.
Figure 2:
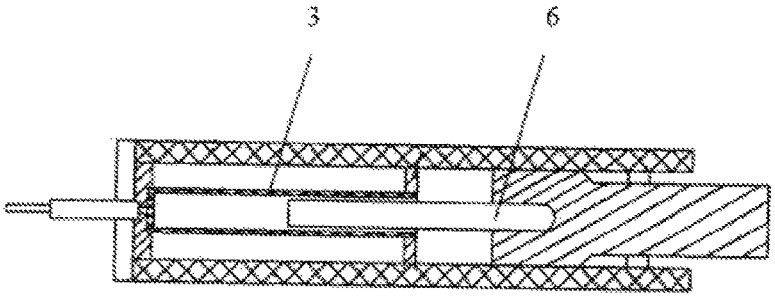
FIG. 2 PRIOR ART
FIG. 2 is a schematic diagram of a phase shifter in the prior art.
Figure 3:
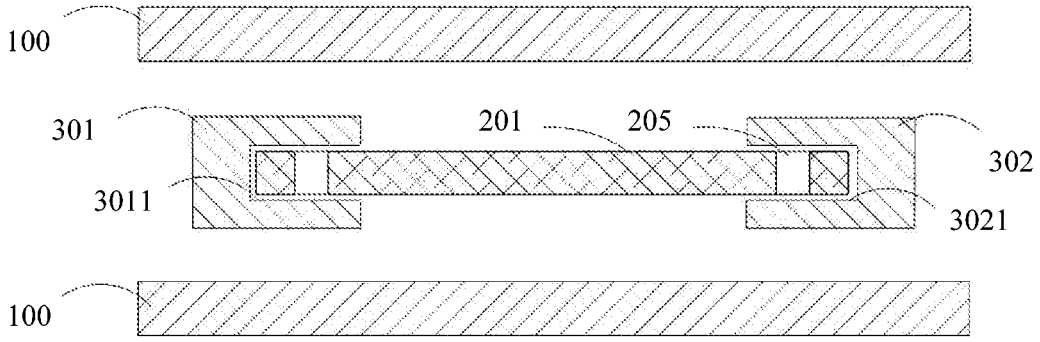
FIG. 3 is a first schematic diagram of a part of a phase shifter according to an embodiment of the present application.

Referring to FIG. 3, FIG. 3 is a first schematic diagram of a part of a phase shifter according to an embodiment of the present application.

As shown in FIG. 3, in a first implementation manner of the present application, the phase shifter includes a cavity 100 and a first fixed transmission line 301 (also shown in FIGS. 6 and 8), a second fixed transmission line 302 (also shown in FIGS. 6 and 8), and a slidable transmission line 201 that are located in the cavity 100. The first fixed transmission line 301 and the second fixed transmission line 302 may be in a shape of a straight strip, and may be bent to be a U shape or another shape. The first fixed transmission line 301 and the second fixed transmission line 302 may be integrated into a same fixed transmission line, or may be two independent fixed transmission lines.

The first fixed transmission line 301 is provided with a first open slot 3011, the second fixed transmission line 302 is provided with a second open slot 3021, and opening directions of the first open slot 3011 and the second open slot 3021 are opposite to each other. That the first fixed transmission line 301 and the second fixed transmission line 302 are two independent fixed transmission lines is used as an example. The two fixed transmission lines are each provided with a lengthwise open slot, the opening directions of the open slots are opposite to each other, and the opening directions of the open slots are parallel to a bottom of the cavity 100. A cross section of the open slot is in a shape of a rectangular frame with only one side removed.

Two ends of the slidable transmission line 201 are respectively engaged in the first open slot 3011 and the second open slot 3021, so that the slidable transmission line 201 is electrically connected to the first fixed transmission line 301 and the second fixed transmission line 302. The slidable transmission line 201 slides relative to the first fixed transmission line 301 and the second fixed transmission line 302. The slidable transmission line 201 is strip-shaped as a whole. The slidable transmission line 201 is clamped in the first open slot 3011 and the second open slot 3021, and can be coupled to a fixed circuit in the open slots to a greater extent. The transmission device needs to apply force in only a sliding direction to the slidable transmission line 201, and does not need to apply pressure in another direction to the slidable transmission line 201, so that the slidable transmission line 201 is tightly coupled to the fixed circuit in the open slots.

Figure 4:
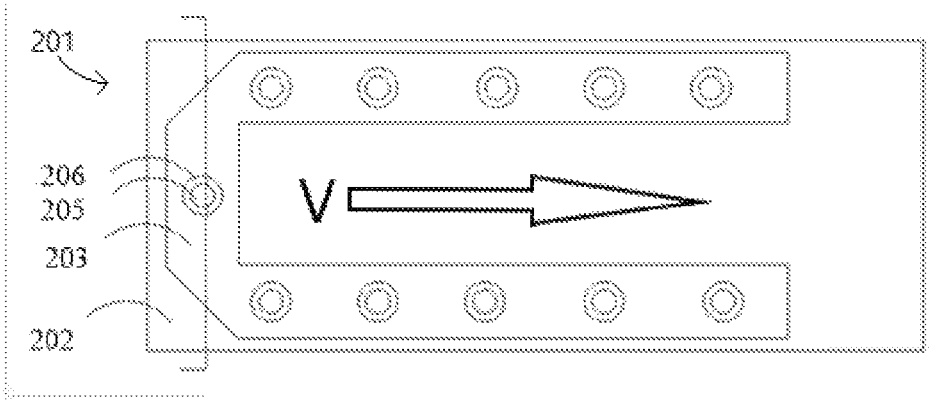
FIG. 4 is a top view of a part of a slidable transmission line of a phase shifter according to an embodiment of the present application.

FIG. 4 is a top view of a part of the slidable transmission line 201 of the phase shifter according to this embodiment of the present application. The slidable transmission line 201 includes a dielectric substrate 202 and a phase-shift circuit 203. The dielectric substrate 202 drives the phase-shift circuit 203 to slide relative to the first fixed transmission line 301 of FIG. 3 and the second fixed transmission line 302 of FIG. 3. As shown in FIG. 4, the dielectric substrate 202 may be a PCB. The dielectric substrate 202 drives the phase-shift circuit 203 to slide relative to the first fixed transmission line 301 of FIG. 3 and the second fixed transmission line 302 of FIG. 3, so that the phase-shift circuit 203 on the dielectric substrate 202 and the fixed circuit in the open slots are coupled to each other. The dielectric substrate 202 continuously slides to change a total length of a transmission line formed by a slot of the first open slot 3011 of FIG. 3, a slot of the second open slot 3021 of FIG. 3 and the phase-shift circuit 203, thereby continuously changing a phase.

Figure 5:
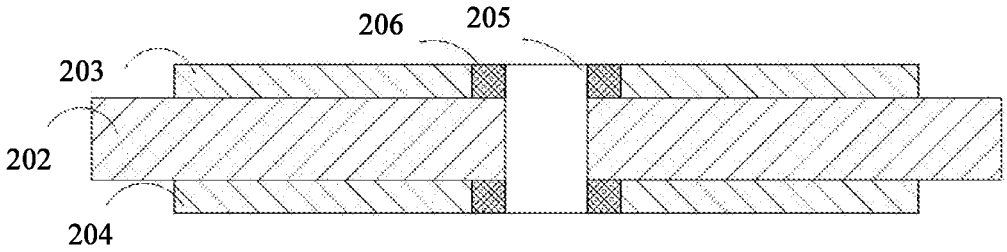
FIG. 5 is a sectional view, in a V direction, of a part of FIG. 4.

In an implementation manner, the phase-shift circuit is disposed on a first surface of the dielectric substrate 202 and a second surface of the dielectric substrate 202, the first surface and the second surface are surfaces that connect the dielectric substrate 202 and the first open slot 3011 and the second open slot 3021, and the first surface and the second surface are disposed opposite to each other. As shown in FIG. 4, a surface presented in the top view of the slidable transmission line 201 may be the first surface, and a surface opposite to the first surface is the second surface. As shown in FIG. 5, a phase-shift circuit 204 is also disposed on the second surface. In addition, the phase-shift circuit 204 on the second surface and the phase-shift circuit 203 on the first surface are symmetrical to each other. However, in a sectional view of a part shown in FIG. 5, the phase-shift circuits disposed on the two surfaces and the dielectric substrate 202 present a "cross" shape as a whole. The phase-shift circuit may be implemented on the dielectric substrate 202 by using an etching process.

In an implementation manner, the phase-shift circuit 203 on the first surface is used as an example. The phase-shift circuit 203 is U-shaped as shown in FIG. 4. Two arms of the phase-shift circuit 203 are respectively disposed at a junction of the dielectric substrate 202 and the first open slot 3011 and a junction of the dielectric substrate 202 and the second open slot 3021, so that the two arms of the phase-shift circuit 203 and the fixed circuit in the first open slot 3011 and the second open slot 3021 are coupled to each other.

In an implementation manner, as shown in FIG. 3, FIG. 4 and FIG. 5, the dielectric substrate 202 is provided with a through hole 205, the through hole 205 is disposed in the phase-shift circuit 203, an inner wall of the through hole 205 is coated with a metal layer, and the phase-shift circuit 203 on the first surface is connected to the phase-shift circuit 204 on the second surface by using the metal layer. There is at least one through hole 205. As shown in FIG. 5, the phase-shift circuit 203 on the first surface, the phase-shift circuit 204 on the second surface, and the through hole 205 present an "I" shape as a whole.

In an implementation manner, to fully connect the phase-shift circuit 203 to the metal layer on the inner wall of the through hole 205, a metal ring 206 (see FIGS. 4 and 5) of a preset width is disposed at an edge of the through hole 205. The metal ring 206 and the through hole 205 are concentric and coaxial, and the metal ring 206 and the phase-shift circuit 203 are connected. Therefore, the phase-shift circuit 203 on the first surface is connected to the phase-shift circuit 204 on the second surface by using the metal ring 206 and the metal layer on the inner wall of the through hole 205.

Figure 6:
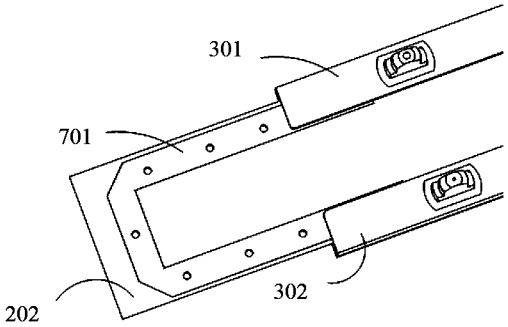
FIG. 6 is a first schematic diagram of an embodiment of a placement area of a phase shifter according to an embodiment of the present application.
Figure 8:
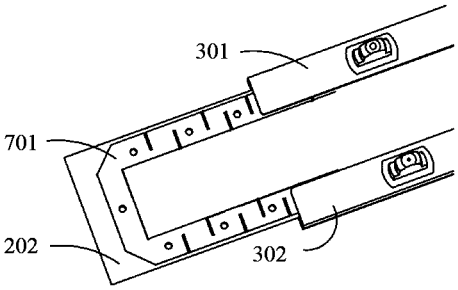
FIG. 8 is a first schematic diagram of another embodiment of a placement area of a phase shifter according to an embodiment of the present application.

In an implementation manner, as shown in FIG. 6 and FIG. 8, the dielectric substrate 202 is further provided with a placement area, and the placement area is configured to receive the phase-shift circuit 203 of FIGS. 4 and 5. The first surface includes a first placement area 701, the second surface includes a second placement area (not shown in these figures), the phase-shift circuit 203 on the first surface is disposed in the first placement area 701, and the phase-shift circuit 204 of FIG. 5 is disposed on the second surface is disposed in the second placement area (not shown in the figure).

Figure 7:
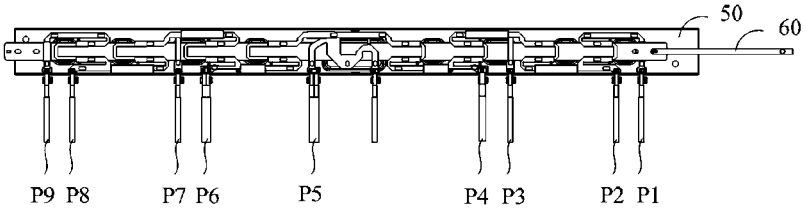
FIG. 7 is a second schematic diagram of an embodiment of a placement area of a phase shifter according to an embodiment of the present application.
Figure 10:
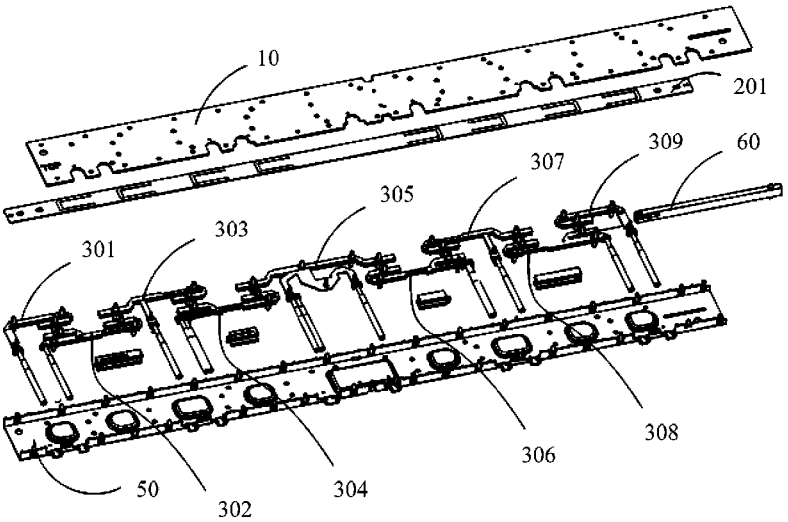
FIG. 10 is a schematic structural diagram of a phase shifter according to an embodiment of the present application.

In an implementation manner, structures of the first placement area 701 and the second placement area (not shown in the figure) are smooth structures. FIG. 6 is the dielectric substrate 202 of FIGS. 4 and 5 whose placement area is in a smooth structure. FIG. 7 is a perspective view of assembly of a phase shifter in a case in which the placement area of the dielectric substrate 202 of FIGS. 4 and 5 is in a smooth structure. As shown in FIG. 10, fixed transmission lines include the first fixed transmission line 301, the second fixed transmission line 302, a third fixed transmission line 303, a fourth fixed transmission line 304, a fifth fixed transmission line 305, a sixth fixed transmission line 306, a seventh fixed transmission line 307, an eighth fixed transmission line 308, and a ninth fixed transmission line 309. The second fixed transmission line 302 includes a first-side fixed transmission line and a second-side fixed transmission line. The third fixed transmission line 303 includes a first-side fixed transmission line and a second-side fixed transmission line. The two ends of the slidable transmission line 201 are respectively clamped between the first fixed transmission line 301 and the first-side fixed transmission line of the second fixed transmission line 302, and between the first-side fixed transmission line of the third fixed transmission line 303 and the second-side fixed transmission line of the second fixed transmission line 302. As shown in FIG. 10, the first surface of the slidable transmission line 201 may be provided with eight phase-shift circuits (disposing of the second surface on the second surface is the same as that of the first surface, and details are not described in this embodiment), which include a first phase-shift circuit, a second phase-shift circuit, . . . , an eighth phase-shift circuit. Four phase-shift circuits including the first phase-shift circuit to the fourth phase-shift circuit are disposed opposite to four phase-shift circuits including the fifth phase-shift circuit to the eighth phase-shift circuit, so as to implement a positive phase and a negative phase when the transmission device pulls the slidable transmission line 201.

In an implementation manner, phase shifters may be classified according to a port quantity into a four-port phase shifter, a five-port phase shifter, a seven-port phase shifter, a nine-port phase shifter, an eleven-port phase shifter, and the like. A nine-port phase shifter is used as an example. With reference to FIG. 7 and FIG. 10, ports of the phase shifter are connected to radiating elements in an antenna array, and are configured to provide an adjusted phase for the radiating elements. When a transmission device 60 is pulled towards an opposite direction of the phase shifter, the slidable transmission line 201 of FIG. 10 slides relatively in open slots of the first fixed transmission line 301 of FIG. 10, the second fixed transmission line 302 of FIG. 10, the third fixed transmission line 303 of FIG. 10, . . . , the ninth fixed transmission line 309 of FIG. 10. As shown in FIG. 7, phases output by a port P1, a port P2, . . . , a port P4 lag behind, and the phases output by the port P1, the port P2, . . . , the port P4 are negative phases. Phases output by a port P6, a port P7, . . . , a port P9 are advanced, and the phases output by the port P6, the port P7, . . . , the port P9 are positive phases. Because there is no fixed transmission line at a port P5, and no phase-shift circuit is disposed at a position, corresponding to the port P5, on the slidable transmission line 201, an output phase of the port P5 is unchanged. It can be determined from a formula $$\Delta\Phi = \beta\Delta L = \frac{2\pi}{\lambda_g}\Delta L$$

($\Delta^{\Psi}$ is an incremental phase, $\lambda_g$ is a wavelength, β is wave transmission constant, and L is a distance that the transmission device 60 slides) that, when the distance that the transmission device 60 slides is L, phases of the phase-shift circuit that are changed due to the sliding are accumulated by using the fixed transmission line. Therefore, a changed phase quantity of the port P1 is four times a changed phase quantity of the port P4. Correspondingly, a changed phase quantity of the port P9 is also four times a changed phase quantity of the port P6. Therefore, a ratio of phases of the port P1 to the port P9 is represented by using $^{\Psi}$ as: P1:P2:P3:P4:P5:P6:P7:P8:P9==$4^{\Psi}$:$-3^{\Psi}$:$-2^{\Psi}$:$-^{\Psi}$:0:$^{\Psi}$:$2^{\Psi}$:$3^{\Psi}$:$4^{\Psi}$.

Figure 9:
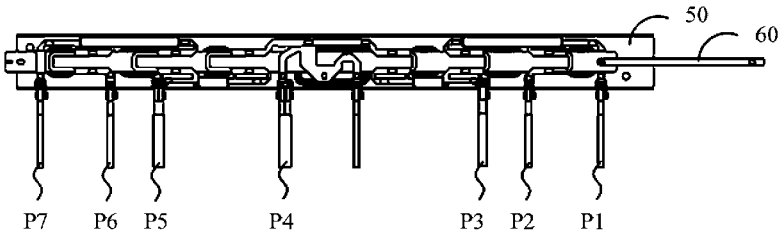
FIG. 9 is a second schematic diagram of another embodiment of a placement area of a phase shifter according to an embodiment of the present application.

In an implementation manner, as shown in FIG. 8, structures of the first placement area 701 and the second placement area (not shown in the figure) are slow-wave structures. The slow-wave structure can implement a non-integer multiple phase-shift ratio, so that phase adjustment is more precise. In addition, a 0%-50% increase in a phase can be implemented according to different distribution densities of slow-wave structures. Compared with a phase shifter whose all placement areas are in a smooth structure, a phase shifter with a slow-wave structure is dramatically decreased in volume while implementing a same phase-shift quantity. The slow-wave structure in this embodiment is described by using an example in which a phase is increased by 20%. In addition, in the phase shifter, structures of some placement areas may also be disposed as slow-wave structures. This embodiment is described by using an example in which structures of placement areas corresponding to the port P1 and the port P7 are slow-wave structures. As shown in FIG. 9, a seven-port phase shifter is used as an example. With reference to FIG. 9, when a distance that the transmission device 60 slides is L, a changed phase quantity of the port P1 is 3.2 times a changed phase quantity of the port P3. Therefore, P1:P2:P3:P4:P5:P6:P7=$-3.2^{\Psi}$:$-2^{\Psi}$:$-^{\Psi}$:0:$^{\Psi}$:$2^{\Psi}$:$3.2^{\Psi}$. Because the dielectric substrate 202 of FIGS. 4 and 5 is a PCB, the slow-wave structure of FIG. 8 may be implemented by using an etching process.

In an implementation manner, a surface of the slidable transmission line 201 of FIG. 3 is coated with an insulation layer, so as to change a dielectric constant of a medium around the slidable transmission line 201 of FIG. 3. The insulation layer is configured to avoid that the slidable transmission line 201 of FIG. 3 and the fixed transmission line are in direct contact, so as to achieve a high power capacity of the phase shifter, and ensure that the phase shifter can work at high power.

Figure 11:
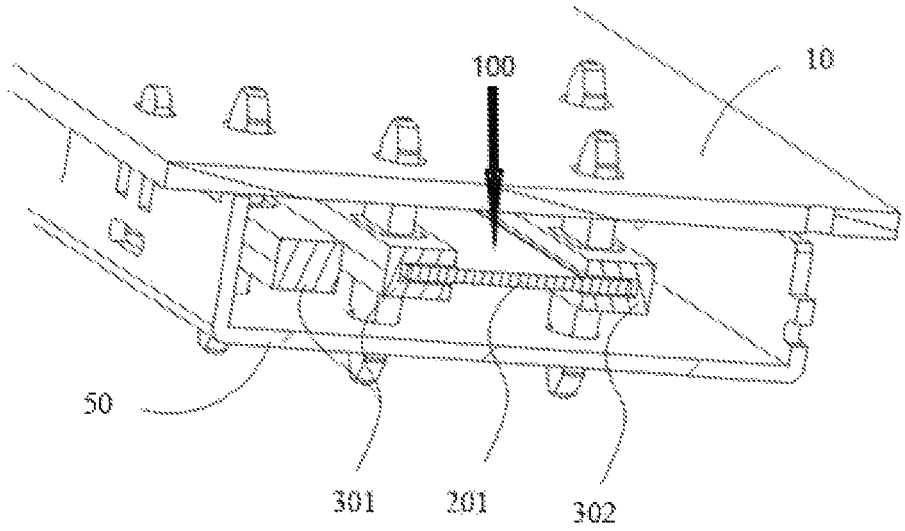
FIG. 11 is a second schematic diagram of a part of a phase shifter according to an embodiment of the present application.

In an implementation manner, as shown in FIG. 11, the cavity 100 includes a first end and a second end. The first end is provided with an accommodation cavity 50 (also shown in FIGS. 7, 9 and 10), the second end is a cover 10 (also shown in FIG. 10), and the accommodation cavity 50 and the cover 10 are joined to each other. The cover 10 and the accommodation cavity 50 may be connected by using soldering tin, or may be connected by using a screw or in another connection manner.

Figure 12:
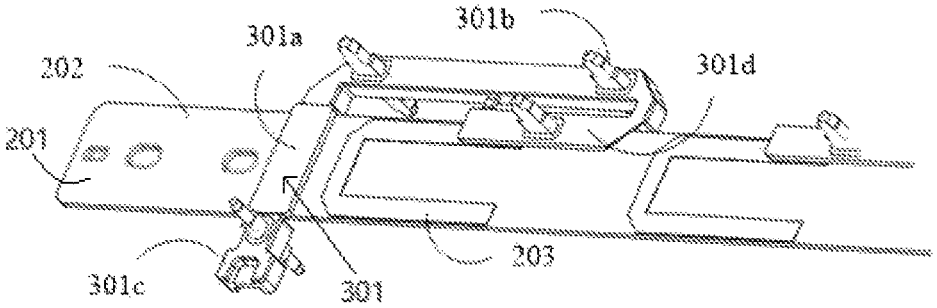
FIG. 12 is a schematic diagram of a part of a fixed transmission line of a phase shifter according to an embodiment of the present application.

In an implementation manner, the first fixed transmission line 301, the second fixed transmission line 302, and the slidable transmission line 201 form a suspended microstrip structure in the accommodation cavity 50. As shown in FIG. 12, the two ends of the slidable transmission line 201 (including the dielectric substrate 202 and the phase-shift circuit 203) are engaged between the second fixed transmission line 302 (the second fixed transmission line 302 is not shown in FIG. 12) and the first fixed transmission line 301. The first fixed transmission line 301 includes a first part 301*a*, a second part 301*b*, a third part 301*c*, and a fourth part 301*d*. Two ends of the first part 301*a* are respectively connected to one end of the fourth part 301*d* and one end of the third part 301*c*. The other end of the third part 301*c* is configured to be connected to a port of the phase shifter, or the other end of the third part 301*c* may be a port of the phase shifter. An open slot in the fourth part 301*d* is connected to the slidable transmission line 201. Materials of the first part 301*a* and the third part 301*c* may be metal materials. A material of the second part 301*b* may a nonmetal material, and the second part 301*b* is configured to fasten the fixed transmission line between the cover 10 and the accommodation cavity 50 of FIG. 11, so that the fixed transmission line and the slidable transmission line 201 forms the suspended microstrip structure in the accommodation cavity 50. The first part 301*a*, the second part 301*b*, and the fourth part 301*d* may be integrally designed, or may be separately processed and integrally assembled.

The phase shifter provided in this embodiment of the present application, as shown in FIG. 3, includes a cavity 100 and a first fixed transmission line 301, a second fixed transmission line 302, and a slidable transmission line 201 that are located in the cavity 100. The first fixed transmission line 301 is provided with a first open slot 3011, the second fixed transmission line 302 is provided with a second open slot 3021, and opening directions of the first open slot 3011 and the second open slot 3021 are opposite to each other. Two ends of the slidable transmission line 201 are respectively clamped in the first open slot 3011 and the second open slot 3021, so that the slidable transmission line 201 is electrically connected to the first fixed transmission line 301 and the second fixed transmission line 302, and the slidable transmission line 201 slides relative to the first fixed transmission line 301 and the second fixed transmission line 302. The fixed transmission lines and the slidable transmission line 201 form a suspended microstrip structure in an accommodation cavity 50, as shown in FIG. 11. The phase shifter has a simple structure and a small volume, and can adjust a phase precisely. A transmission device 60 needs to pull only the slidable transmission line 201 to adjust the phase, and does not need to apply additional pressure in another direction. The phase shifter is simple for operation, and has a low performance requirement for the transmission device 60, as shown in FIGS. 7, 9 and 10.

Finally, it should be noted that the foregoing embodiments are merely intended for describing the technical solutions of the present application but not for limiting the present application. Although the present application is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present application.

What is claimed is:

1. A phase shifter, comprising a cavity and a first fixed transmission line, a second fixed transmission line, and a slidable transmission line that are located in the cavity; wherein:

the first fixed transmission line is provided with a first open slot, the second fixed transmission line is provided with a second open slot, and opening directions of the first open slot and the second open slot are opposite to each other, two ends of the slidable transmission line are respectively engaged in the first open slot and the second open slot, so that the slidable transmission line is electrically connected to the first fixed transmission line and the second fixed transmission line, and the slidable transmission line slides relative to the first fixed transmission line and the second fixed transmission line, the slidable transmission line comprises a dielectric substrate and a phase-shift circuit, and the dielectric substrate drives the phase-shift circuit to slide relative to the first fixed transmission line and the second fixed transmission line, and the phase-shift circuit is disposed on a first surface of the dielectric substrate and a second surface of the dielectric substrate, the first surface and the second surface are surfaces that connect the dielectric substrate and the first open slot and the second open slot, and the first surface and the second surface are disposed opposite to each other.

2. The phase shifter according to either of claim 1, wherein a surface of the slidable transmission line is insulated.

3. The phase shifter according to claim 1, wherein the cavity comprises a first end and a second end, the first end is provided with an accommodation cavity, the second end is a cover that covers the accommodation cavity.

4. The phase shifter according to claim 3, wherein the first fixed transmission line, the second fixed transmission line, and the slidable transmission line form a suspended microstrip structure in the accommodation cavity.

5. The phase shifter according to claim 1, wherein the dielectric substrate is provided with a through hole, the through hole is disposed in the phase-shift circuit, and the phase-shift circuit on the first surface is connected to the phase-shift circuit on the second surface.

6. The phase shifter according to claim 5, wherein a metal ring of a preset width is disposed at an edge of the through hole, the metal ring and the through hole are concentric and coaxial, and the metal ring and the phase-shift circuit are connected.

7. The phase shifter according to claim 1, wherein the first surface comprises a first placement area, the second surface comprises a second placement area, the phase-shift circuit on the first surface is disposed in the first placement area, and the phase-shift circuit on the second surface is disposed in the second placement area.

8. The phase shifter according to claim 7, wherein a structure of the first placement area and a structure of the second placement area are both smooth structures.

9. The phase shifter according to claim 7, wherein a structure of the first placement area and the structure of the second placement area are both slow-wave structures.

* * * * *